US005339735A

United States Patent [19]

Corderman

[11] Patent Number: 5,339,735

[45] Date of Patent: Aug. 23, 1994

[54] DIALAMATIC STENCIL NUMBERING MACHINE

[76] Inventor: Daniel D. Corderman, 425 N. Hough St., Barrington, Ill. 60010

[21] Appl. No.: 46,653

[22] Filed: Apr. 13, 1993

[51] Int. Cl.[5] ..... B41L 13/00

[52] U.S. Cl. ..... 101/114; 118/305; 101/35

[58] Field of Search ..... 101/114, 129, 35; 118/305, 301

[56] References Cited

U.S. PATENT DOCUMENTS

| | | | |
|---|---|---|---|
| 2,152,274 | 8/1936 | Papazian | 101/114 |
| 3,240,184 | 3/1966 | Mieux et al. | 118/305 |
| 3,352,283 | 9/1965 | Maus | 118/305 |
| 4,893,751 | 1/1990 | Armstrong | 118/305 |
| 5,148,988 | 9/1992 | Smrt | 118/301 |

FOREIGN PATENT DOCUMENTS

| | | | |
|---|---|---|---|
| 0344227 | 6/1904 | France | 101/114 |
| 0031850 | of 0000 | Switzerland | 101/114 |

*Primary Examiner*—Edgar S. Burr
*Assistant Examiner*—Anthony H. Nguyen

[57] ABSTRACT

A stencil arranging apparatus for spray painting numbers on the surface of parking lots or floors providing a pair of stencil wheels when rotated provide two digit numbers masked by the stencil wheels and a cutout platform with an overspray guard mounted to a L frame on wheels that can allow apparatus to lie flat on the surface for painting or by tipping L frame back can mobilize apparatus for moving to next area to be numbered.

1 Claim, 6 Drawing Sheets

DIALAMATIC STENCIL NUMBERING MACHINE

Figure 1:
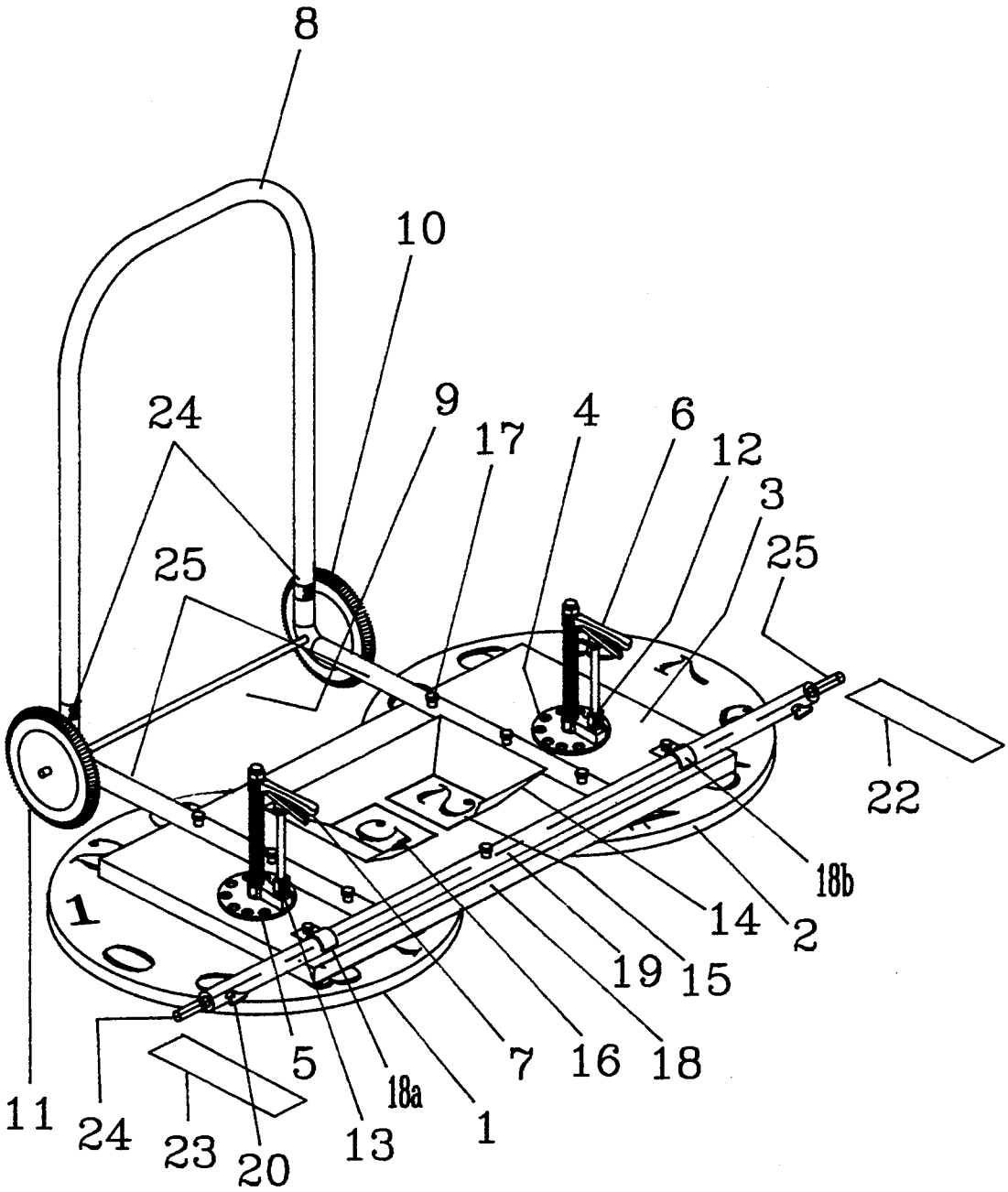

This invention relates to the numbering of parking lot spaces after the parking space lines have been painted on the concrete or asphalt parking lot surface.

The conventional way of painting the numbers with spray paint has been to lay the stencils of numbers on the surface and surrounding them with cardboard or other sheets of material to prevent overspray around the numbers.

I have many spaces to number in parking lots with up to one hundred spaces or less. I have searched many catalogues of related supplies which offers the stencils to be used in the manner mentioned in the preceding paragraph.

Accordingly, it is the object of the present invention to arrange stencils easily to spray paint one or two digit numbers on the surface using this machine and spray paint by rotating two stencil numbered disc's each numbered 0 through 9 to create any number from 0 through 99.

Another object of this invention is to provide easy mobility of moving to the next parking space to be numbered by rotating either stencil disc to create the next desired numbered to be painted on the surface by pulling back on the handle bar lifting the stencil main frame off the surface for easy moving and changing to the next desired number.

Another object of the invention is to center the numbers to be painted between the parking space lines easily without measuring for the center each time the machine is moved to the next space.

These, together with other objects, will become more fully apparent upon reference to the following description and accompanying drawings of the machine.

In the drawings:

FIG. 1—Is a perspective three dimensional view of the present invention in its assembled state after the working model.

Figure 2:
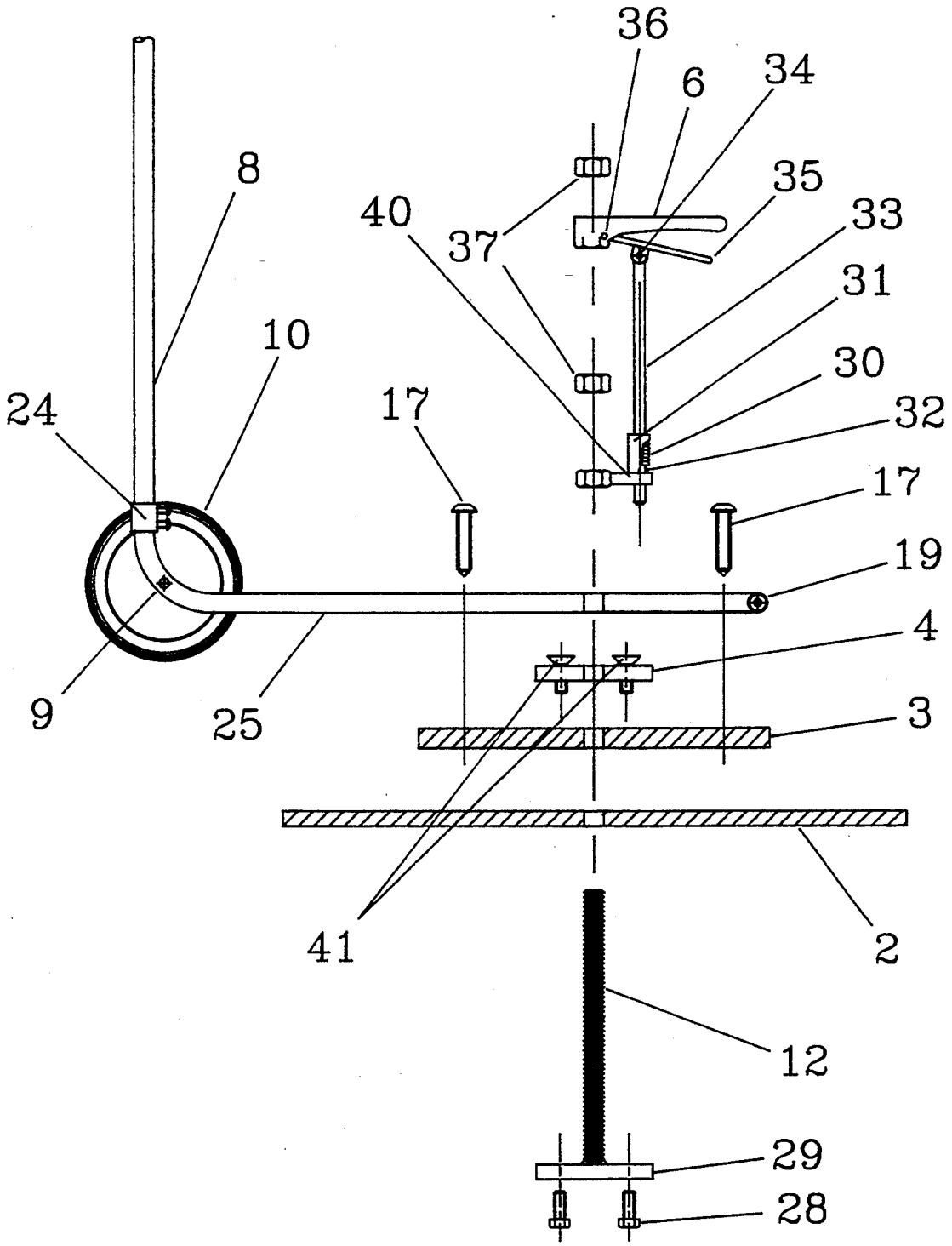

FIG. 2—Is a side view of assemblable parts of one of the two stencil disc's to be incorporated with the stencil disc main frame and of the mobile frame to the main stencil frame.

Figure 3:
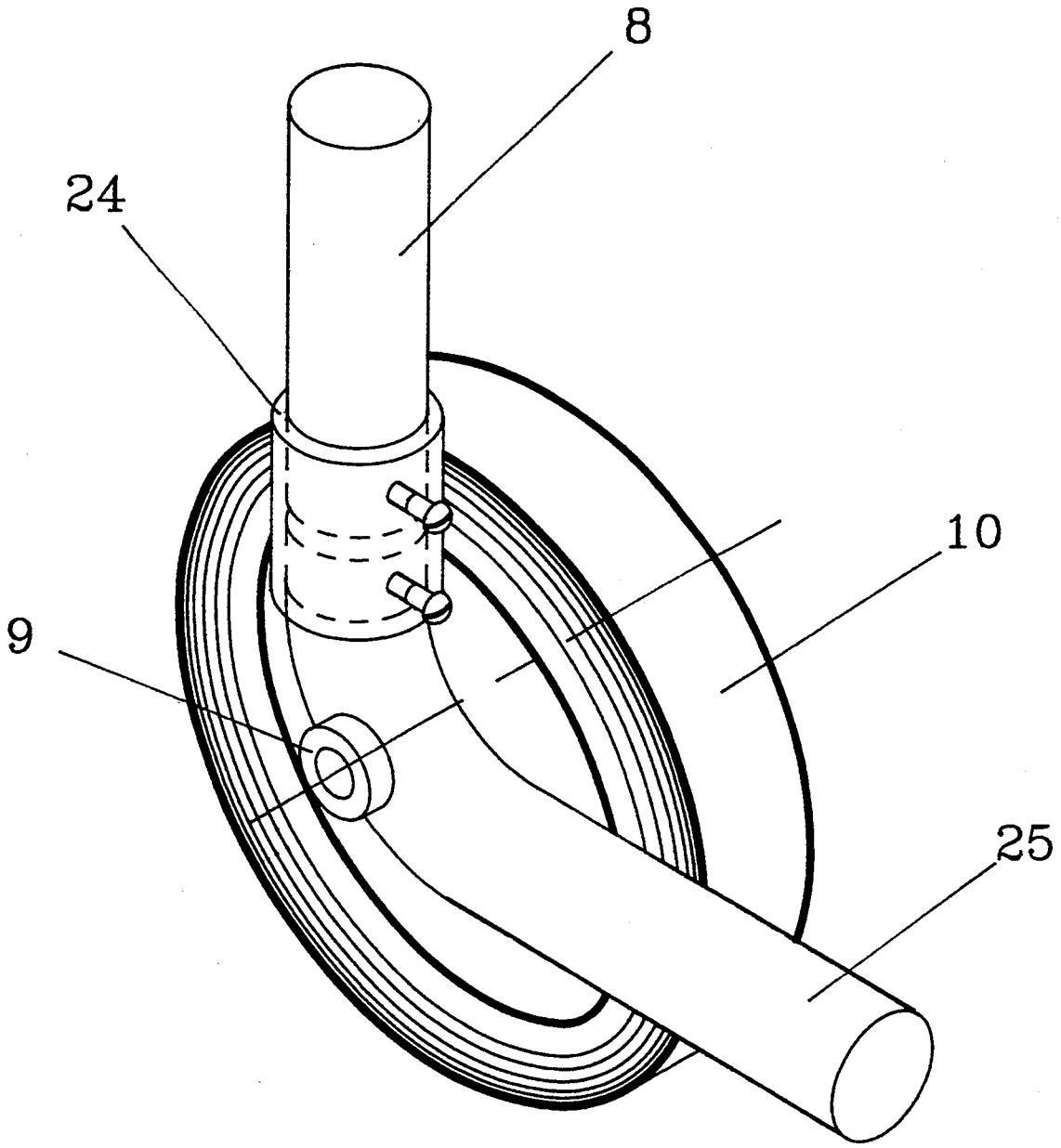

FIG. 3—Is a partial sectional view side elevation of the mobility frame and handle bar with coupling device allowing the handle bar to be detached for storage or hauling ease. There is also a wheel and axle for moving from one parking space to another.

Figure 4:
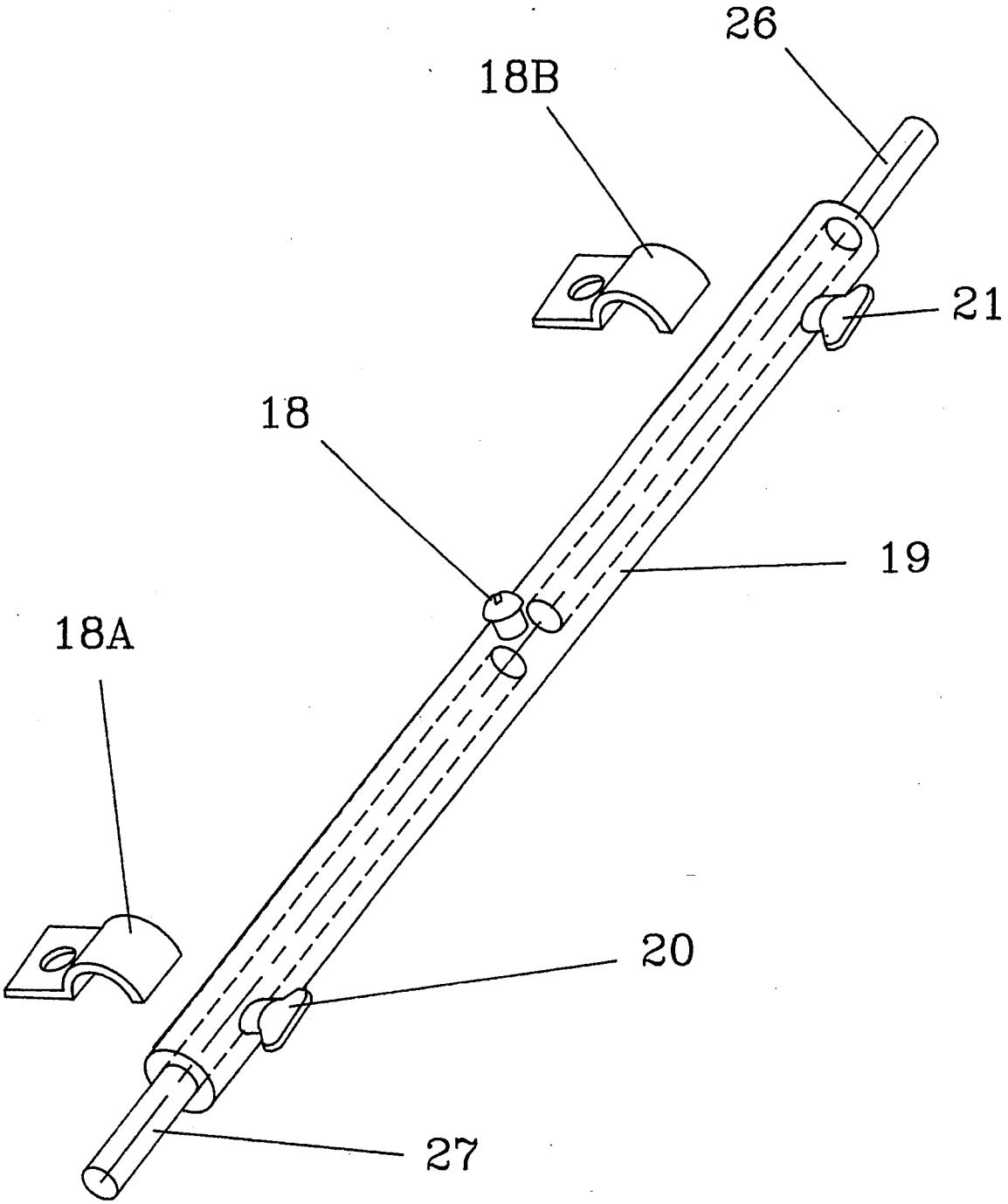

FIG. 4—Is a three dimensional view of the adjustable centering device for centering the machine so the numbers will be painted in equal distance between parking strips.

Figures 5, 6:
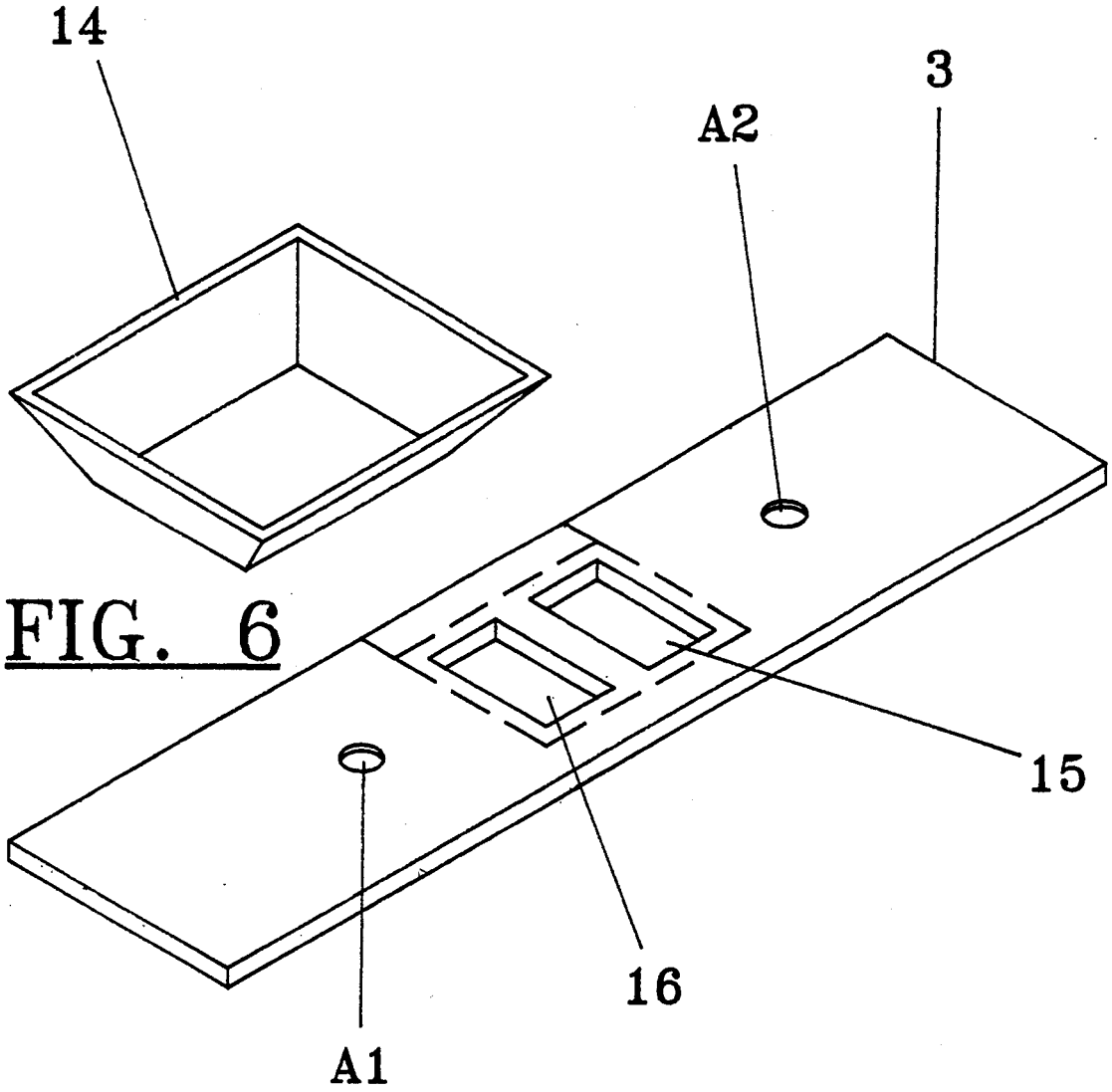

FIG. 5—Is a three dimensional view of the main stencil disc frame showing cutouts to expose stencil numbers to be spray painted on the surface.

FIG. 6—Is a three dimensional view of the paint overspray guard surrounding the two cutouts of the main stencil disc frame.

Figure 7:
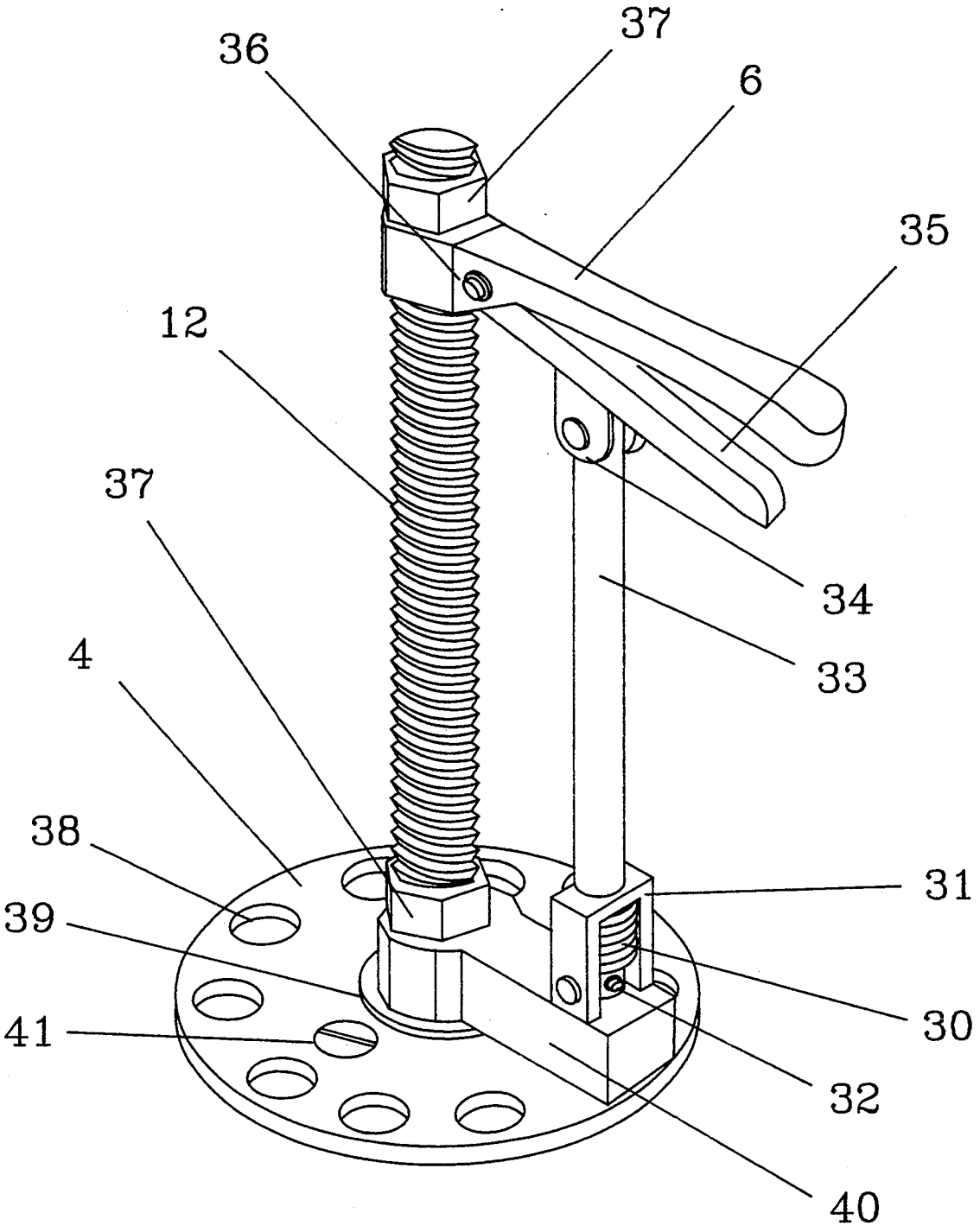

FIG. 7—Is a three dimensional view of the stencil disc position lock and release handle assembly, fully assembled.

Referring now to the drawings by reference numerals and a few alphabetic letters, my invention designated genarally by FIG. 1 as being in its working position on a parking lot surface between painted parking space strips designated by phantom lines 22 and 23 and ready to have the number 25 painted on the surface, all painting whether arosal or air pressure spray to be hand held and operated because of light repeated sprays needed to prevent number edge holder or trigger mechanism, although I have provided for the overspray wind guard 14 shown enlarged in the FIG. 6 drawing. Cut outs 15 and 16 expose stencils to paint.

The principal claim of my invention 1 and 2 are the rotating stencil disc's each approximately 30 inches in diameter having stencil numerals located consecutively at 36 degree intervals, 0 through 9 along the edge of the disc, the disc can be made out of sheet metal, fiberglass, acrylic, aluminum or in the case of my working model, Masonite. Cutouts are at 36 degress, large enough for four inch steel stencil numbers to be riveted in place of cutouts. If in the case of mass production, stencil numerals could be punched out or cut out directly from the sheets of material along with the discs from the sheets from the same materials.

The stencil disc which is secured to the positioning handle shaft also acts as axle 12 and 13 for the disc, enlarged view shown in FIG. 7, this axle of the stencil disc inserted through axle bearing and position lock 4 and 5 enlarged in FIG. 7 of the stencil disc main frame 3 and also FIG. 5.

Lock and release handle 6 and 7 installed on the upper end of the stencil disc shaft enlarged in FIG. 7 and side view as shown in FIG. 2 rotates the disc and locks the disc in place and releases to move the stencil disc to the next numeral desired.

Handle bar 8 coupled to the mobility main frame 25 by couplers 24, FIG. 3 shows sectional enlarged view, along with the combination mobility frame stabilizer 9 and mobility wheel axle, mobility wheels 10 and 11 are installed, then mobility wheel frame 25 connected with stencil disc main frame 3 by screws or small bolts 17, the adjustable centering device 19 secured to the stencil disc main frame by center stop screw or bolt 18 and 18A and 18B conduit clamps to secure ends of centering device shown on enlarged view FIG. 4 centering device being made of one half inch metal or plastic tubing 26 and 27 (FIG. 1 and 4) telescoping out of the three quarter inch tubing 19 (FIGS. 1, 2 and 4) equally to center numerals between parking space lines then locked in place by set screws 20 and 21 on each end A and B as shown in FIG. 4.

The stencil disc secured to the positioning handle shaft 12 (FIG. 2) and 12 and 13 (FIG. 1) by rivets 28 to plate 29 (FIG. 2) also acts as axles to the discs 1 and 2 (FIG. 1 and 2 enlarged). This assembly can be inserted through main frame or platform holes A2 (FIG. 5) then through 4 (FIG. 2) position peg lock plate with synchronized lock holes at 36 degree spacing to synchronize lock holes with stencil numerals, plate 4 can then be secured to main frame with flathead screws 41 but not protruding through the main frame or platform 3 (FIG. 2), positioning peg lower frame 40 (FIG. 2 and 7) threaded onto positioning handle shaft 12 (FIG. 2 and 7) along with prebuilt spring cage 31 to the extent that it fits the stencil disc close to the main frame but not so close that the disc will not turn freely and parallel to the center line of the center disc hole and the center of the stencil number, then locked in place by locking nut 37 (FIG. 2 and 7), position handle 6 (FIGS. 1, 2 and 7) threaded onto positioning handle shaft 12 (FIGS. 1, 2 and 7) being set parallel to positioning peg lower frame 40 and with positioning peg 33 allowing peg to protrude to lock in positioning plate 4 holes 38 then pins 34 and 36 installed in movable part of positioning handle lever 35 all locked together with locking nut 37. Mobility frame 25 attached to main frame 3 (FIG. 1 and 2) by screws or rivets 17 to complete assembly.

While I have shown particular forms of embodiment of my invention, I am aware that some minor changes therein will readily suggest themselves to others who are skilled in the art without departing from the spirit and scope of the invention.

I claim:

1. A mobile stencil apparatus for printing on a surface including a generally "L" shaped frame with wheels mounted near the intersection of the legs of said "L", said wheels rolling on the surface to be printed upon, one leg of said "L" serving as a handle and the other leg of said "L" having a plurality of stencil wheels rotatably mounted thereon and positioned in a plane which is substantially parallel to the surface to be printed upon, each stencil wheel having a plurality of characters arranged in a circle near its circumference whereby each of said stencil wheels may be rotated to bring a character which it is to be printed to a printing position, means to releasably lock each of said stencil wheels to position and maintain a desired character at a printing position, said means to releasably lock including means to unlock said stencil wheels to permit the selection of a different character for printing by rotation of the stencil wheels, and means connected to said other leg of said "L" to enable the centering of the printed characters in a desired space whereby successive desired spaces can be printed in by tilting said "L" shaped frame to lift said stencil wheels from said surface and rolling said stencil printing apparatus to the next space to be printed in and permitting said "L" shaped frame to pivot about said wheels to again position said stencil wheels on said surface.

* * * * *